United States Patent [19]

Spelber et al.

[11] 4,399,947

[45] Aug. 23, 1983

[54] VALVE MECHANISM FOR A WATER OPERATED WASTE DISPOSAL UNIT

[75] Inventors: Leonard G. Spelber; Abraham I. Tucker, both of San Diego, Calif.

[73] Assignee: Wastemate Corp., San Diego, Calif.

[21] Appl. No.: 312,093

[22] Filed: Oct. 16, 1981

[51] Int. Cl.[3] ..... B02C 18/40

[52] U.S. Cl. ..... 241/46 B; 91/308; 91/318; 91/339; 92/121; 241/100.5; 241/257 G

[58] Field of Search ..... 91/308, 318, 339, 327; 92/120, 121; 241/100.5, 46, 46 A, 46 B, 257 G, 101.2, 46.17

[56] References Cited

U.S. PATENT DOCUMENTS 4,082,229 4/1978 Boosman ..... 241/257 G X

*Primary Examiner*—Mark Rosenbaum

*Attorney, Agent, or Firm*—Brown & Martin

[57] ABSTRACT

A valve mechanism for a water actuated waste disposal unit includes a reciprocating control valve for actuating an operating piston with cutters attached thereto. The control valve is cycled by a pilot valve. Passages in the valve mechanism are constructed and arranged for optimum operation and cycle time with minimum leakage.

9 Claims, 5 Drawing Figures

FIG. 4
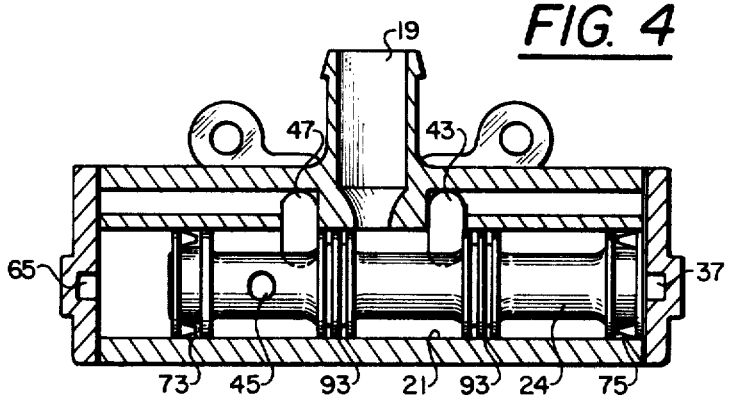
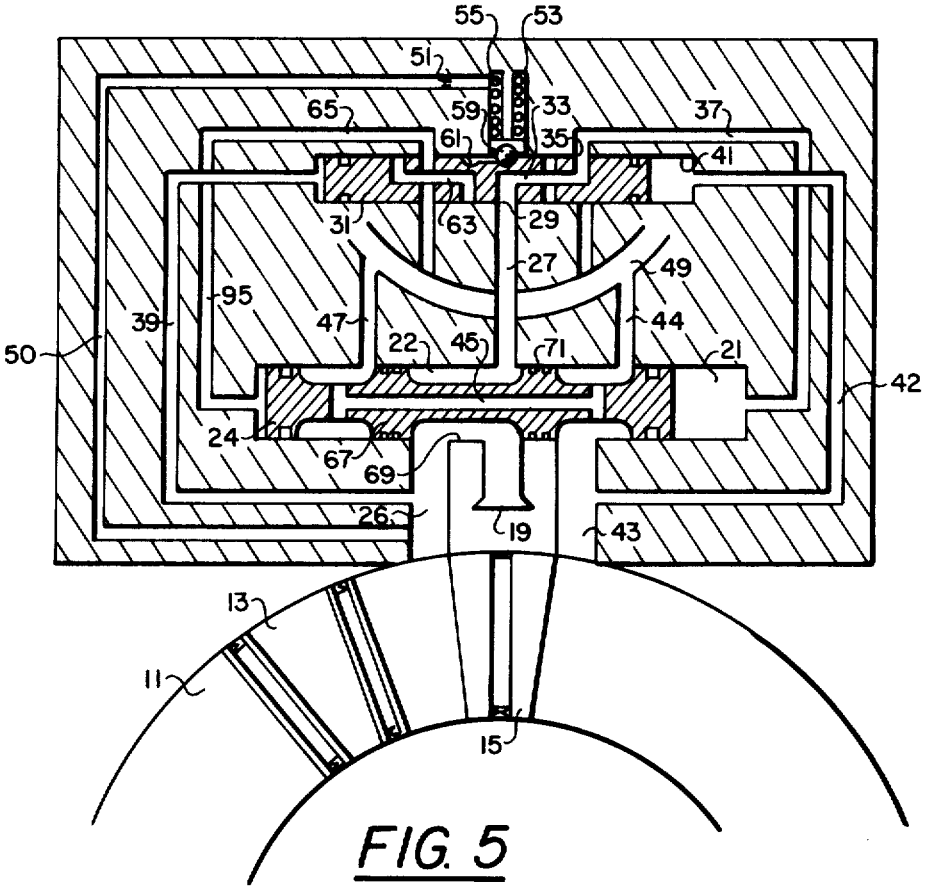
FIG. 5

VALVE MECHANISM FOR A WATER OPERATED WASTE DISPOSAL UNIT

The present invention relates to control valves and more particularly to a servo type control valve construction for use in a water driven waste disposal unit such as shown in U.S. Pat. No. 4,082,229.

BACKGROUND OF THE INVENTION

U.S. Pat. No. 4,082,229 discloses a waste disposal unit operated entirely by water from a domestic water supply. A piston moving in a toroidal chamber and driven by water pressure is coupled to a stack of alternately moving and stationary cutters. The moving cutters have a reciprocating rotary motion and are provided with staggered interfitting teeth which reduce waste material progressively to small particles. The lowermost cutter has restricted openings which will not pass any large particles, or silverware or the like which may accidentally fall into the unit.

A servo controlled valve, responsive to differential pressure on opposite sides of the piston, reverses the water flow and the piston direction automatically at each end of a stroke. The automatic reversal also occurs if an obstruction jams the cutters, the cutters then oscillating with a reduced stroke until the obstruction is cut off or removed.

The driving water is exhausted through the valve into a manifold from where it is sprayed into the cutting chamber to flush waste material through the cutters.

The device described in Pat. No. 4,082,229 is a very efficient device that requires effective sealing and the minimizing of cross leakage between the channels and passages which conduct the water for the operation of the waste disposal unit. It is also desirable that the device by constructed and arranged so that the cycle time for rotation of the cutters is as short as possible.

SUMMARY OF THE INVENTION

Therefore, it is a principle object of the present invention to provide a new and improved valve arrangement for a water driven waste disposal unit which minimizes leakage of water between channels and passages.

It is another object of the present invention to provide a new and improved valve arrangement for a water driven waste disposal unit that makes maximum use of the energy provided by the water pressure in operating the device.

It is another object of the present invention to provide a new and improved valve arrangements for a water driven waste disposal unit that is fast and dependable in operation and that minimizes cycle time of the waste disposal unit.

It is a further object of the present invention to provide a new and improved valve arrangement for a water driven waste disposal unit wherein sticking of the servo valve mechanism can be quickly and easily relieved without disassembling the valve construction.

Other objects of the invention will appear from a reading of the following specification which makes reference to the accompanying drawings.

The above objects are attained with an exemplary embodiment of the present invention wherein water is directed to a pilot piston means which passes the water to the control piston means for operating the cutters. The control piston means is reversed by the action of the pilot piston means. The housing for the control piston means and pilot piston means is sturdy to avoid distortion and the various piston means are provided with seals to provide smooth, efficient sealing. The passage means for directing water flow through the control and pilot piston means are arranged to minimize cross leakage.

DESCRIPTION OF THE DRAWINGS

FIG. 4 is a sectional view taken along the line 4—4 in FIG. 2.

FIG. 5 is a schematic view, in section, demonstrating the operation of the valve arrangement of the present invention.

DETAILED DESCRIPTION OF THE INVENTION

Figure 1:
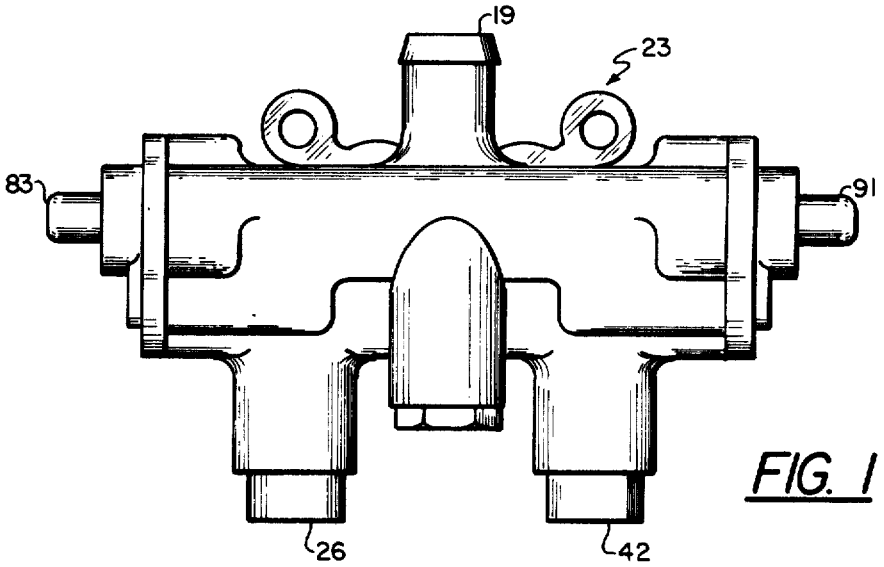
FIG. 1 is a plan view of a valve constructed according to the present invention.
Figure 2:
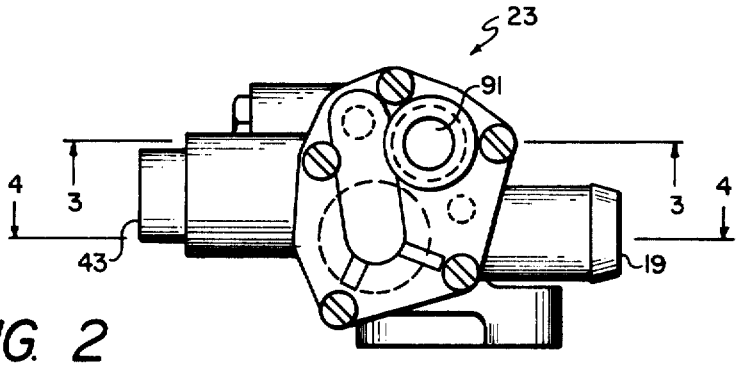
FIG. 2 is a right end elevation of the valve shown in FIG. 1.

Referring to FIG. 5 of the drawings, the waste disposal unit such as shown in U.S. Pat. No. 4,082,229 includes a toroidal chamber 11 with an operating piston 13 slidably disposed therein. A stop plug or bulkhead 15 is positioned in the chamber 11. Water pressure moves the piston 13 first in one direction and then in the reverse direction in the chamber 11 as explained hereafter. Cutters (not shown) are connected to the piston 13 as described in U.S. Pat. No. 4,082,229. The pilot piston 31 and control piston 24 of the valve assembly 23 are positioned to drive piston 13 in a counterclockwise direction. The cylinder walls in the valve assembly 23 are sufficiently thick so that they will not distort under water pressure. In the position shown in the drawings, water from the water supply (not shown) is introduced from the inlet 19, through the passage 26 and into chamber 11. This moves the piston 13 in a counterclockwise direction. The inlet water is also directed through channel 22 in control piston 24, through passage 27 in the valve body to the opening 29 in pilot piston 31, through internal passage 33 in the pilot piston and out the opening 35 to passage 37 which introduces the inlet water to the right end of control piston 24. Control piston 24 is held to the left and the passages are aligned as shown. Inlet water also passes through passage 39 to the left end of pilot cylinder 41, and the right end of pilot cylinder 41 is connected through passage 42 to exhaust.

Water which is pushed ahead of operating piston 13 in chamber 11 exhausts through passage 43 and through passages 44, 45 and 47 to the shower cone passage 49 where it flushes the waste in the disposal unit as described in U.S. Pat. No. 4,082,229. Water at the left end of control piston 24 exhausts through passage 65 to the shower cone passage 49.

Inlet pressure also is fed through passage 50 and orifice 51 into chamber 53. A spring 55 is disposed in chamber 53 and urges piston 57 against detent ball 59 which seats in one of the detent pockets 61.

Thus, a pressure differential exists between the ends of pilot cylinder 41. However, pilot piston 31 is retained by spring-loaded detent ball 59. The pressure through line 50 in chamber 53 from water supply adds to the spring pressure so that the detent is preloaded in accordance with the existing supply pressure.

During a normal stroke, a back pressure is created by the resistance of the water exhausting through a restricted outlet while the supply water has a slight drop through the valve unit and the differential is insufficient to overcome the detent. As the operating piston 13 reaches the end of its travel and the water being pushed ahead of the piston is exhausted, the back pressure drops significantly and the supply pressure driving the piston causes a large pressure differential across the pilot piston 31. Pressure from the supply inlet to the left end of pilot cylinder 41 becomes sufficient to overcome the detent and drive pilot piston 31 to the other end of the cylinder. As the piston 13 engages bulkhead 15, a pressure spike is created. However, because of the orifice 51, the pressure spike is not sensed inside detent chamber 53. The spring 55 is compressed as the pilot piston 31 moves to the right and the ball 59 seats in the left detent 61 in the pilot piston 31.

As the pilot piston 31 moves to the right, the passages are aligned so that passage 63 aligns with passages 27 and 65 and inlet pressure is directed through these passages. Passage 37 now becomes the outlet or exhaust passage for the control cylinder 24. Control piston 24 is shifted to the right so that land 67 on piston 24 seats on land 69 and land 71 moves to the right of passage 43. The inlet passages become the outlet passages and the outlet passages become the inlet passages.

At each end of the piston travel, reversal is automatically initiated by the pressure differential across the servo spool. Reversal will also occur if the cutters are jammed by an obstruction or object too hard to cut, resulting in a sudden increase in pressure differential on opposite sides of the piston. The action is automatic at any supply pressure, since the pilot piston detent is pressure balanced to the supply. It has been found that the cutters will continue to oscillate through any length of stroke until the obstruction is eventually cut off or removed.

Figure 3:
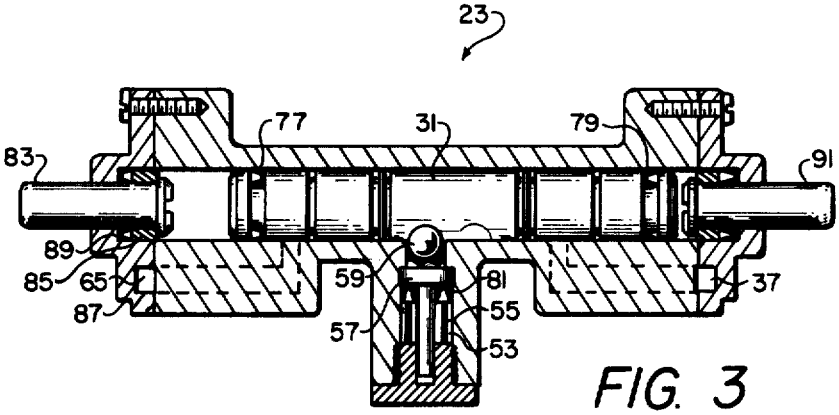
FIG. 3 is a sectional view taken along the line 3—3 in FIG. 2.

Referring to FIGS. 3 and 4, it will be noted that control piston 24 includes contains rubber cup seals 73 and 75 at each end. Contained rubber cup seals 77 and 79 are provided at each end of pilot piston 31 and a rubber cup seal 81 is engaged by spring 55 in chamber 53. These rubber cup seals provide maximum protection against leakage and accommodate movement with a minimum of friction and binding.

A reset rod 83 extends out the left end of pilot cylinder 41 and is in sliding engagement with Teflon sleeve 85 which is press fitted into end cap 87 of the valve assembly 23. A cup seal 89 is positioned inside the sleeve 85 to protect against leakage when the rod 83 is moved. If for some reason the pilot piston 31 becomes stuck because of a particle in the water, the reset rod 83 can be pushed in against the left end of pilot piston 31 to move the piston and reactivate the system. An identical reset rod 91 and accompanying structure is supplied at the right end of the pilot cylinder 41 to move the piston to the left.

The valve assembly 23 is connected in place by connecting passages 26 and 43 to the waste disposal unit and connecting passage 19 to the water supply.

The disk portions 93 on control piston 24 provide a good sealing engagement with the walls of control cylinder 21 without binding and help maintain alignment of the piston within the cylinder. The passages are made large enough so that, in cooperation with other features of the present invention, the cycle time of the control piston 24 from one position to the other is minimized. A cycle time of approximately two seconds has been obtained with the valve assembly shown in the drawings.

Having thus described our invention, we claim:

1. A valve assembly for a water actuated waste disposal unit that includes an annular toroidal chamber with stop means therein and an operating piston slidably mounted in said toroidal chamber and connected with cutting means for cyclically rotating said cutting means in opposite directions, said toroidal chamber having water inlet means on each side of said stop means, comprising:

a valve unit having source connection means for connection to a source of pressurized water and including a valve body having a control cylinder therein;

chamber connecting passage means in said valve body communicating with said toroidal chamber;

a control piston slidably disposed in said control cylinder and including a circumferential supply channel for providing supply water from said source connection means through first passage means in said valve body;

a pair of circumferential exhaust channels on said control piston, one on each side of said circumferential supply channel and separated therefrom by land means on said control piston, and alternately connected by second passage means internally located in said control piston for exhausting water through third passage means in said valve body;

a pilot cylinder in said valve body;

a pilot piston slidably disposed in said pilot cylinder, said pilot piston having internal channels for mating with said first passage means in said valve body and diverting supply water alternately to opposite ends of said control cylinder, the opposite ends of said pilot cylinder being connected with said chamber connecting passage means whereby the pilot piston is responsive to differential pressure on opposite sides of said chamber connecting passage means;

spaced apart pairs of openings on the circumference of said pilot piston for alternately aligning with said first passage means in said valve body, each of said pairs of openings communicating with a separate internal passage in said pilot piston;

exhaust passages in said pilot piston for alternately aligning with exhaust passages in said valve body to exhaust water from each end of the said control cylinder; and biasing means for holding said pilot piston at each end of its reciprocating stroke, said biasing means preventing movement of said pilot piston between opposite ends of the pilot cylinder below a predetermined pressure.

2. A valve assembly according to claim 1 wherein the pilot piston and control piston are provided with contained rubber cup seals adjacent their ends.

3. A valve assembly according to claim 1 wherein reset means is provided on said pilot cylinder to manually shift said pilot piston in either direction if it becomes stuck.

4. A valve assembly according to claim 3 wherein said reset means includes a pair of rod means, one extending axially into each end of said pilot cylinder and slidably engaged with the ends of said pilot cylinder; and sealing means is provided in said pilot cylinder to seal said slidable rod means against leakage.

5. A valve assembly according to claim 1 wherein said land means is of substantial width relative to the piston diameter for sealing and guiding purposes.

6. A valve assembly according to claim 5 wherein the land means is formed of a plurality of land sections.

7. A valve assembly according to claim 1 wherein the passages and channels are large relative to the cylinder diameters to allow rapid water flow and aid in providing a short cycle time for the water actuated waste disposal unit as the operating piston in the toroidal chamber rapidly reciprocates between its extreme positions against opposite ends of said stop plug.

8. A valve assembly according to claim 1 wherein said bias means includes a two position detent engaging said pilot piston for holding the pilot piston at each end of its reciprocating stroke with spring biasing means positioned in a spring chamber that loads said detent to prevent movement of the pilot piston below a predetermined pressure differential between opposite ends of the pilot piston; and a passage connects the water supply with said spring chamber, said passage including means for limiting the effect of pressure surges on said detent.

9. A valve assembly according to claim 8 wherein the means for limiting the effective pressure surges is an orifice.

* * * * *